United States Patent [19]

Smith et al.

[11] Patent Number: 4,893,131

[45] Date of Patent: Jan. 9, 1990

[54] MOBILE OR GROUND MOUNTED ARCUATE ANTENNA

[76] Inventors: William J. Smith; Jack M. Smith, both of 4772 Prescot Dr., Bethel Park, Pa. 15102

[21] Appl. No.: 206,806

[22] Filed: Jun. 15, 1988

[51] Int. Cl.[4] ..... H01Q 1/32; H01Q 9/30

[52] U.S. Cl. ..... 343/713; 343/745; 343/750; 343/861

[58] Field of Search ..... 343/745, 749, 750, 752, 343/722, 825, 828, 829, 830, 847, 711, 713, 845, 861

[56] References Cited

U.S. PATENT DOCUMENTS

| | | | |
|---|---|---|---|
| 1,295,245 | 2/1919 | Weagant | 343/722 |
| 2,203,986 | 6/1940 | Farwell | 343/713 |
| 2,229,865 | 1/1941 | Morgan | 343/722 |
| 2,282,292 | 5/1942 | Amy et al. | 343/722 |
| 2,400,551 | 5/1946 | Hings | 343/847 |
| 2,578,154 | 12/1951 | Shanklin | 343/750 |
| 2,771,604 | 11/1956 | Goldstein | 343/749 |
| 3,100,893 | 8/1963 | Brueckmann | 343/861 |
| 3,464,015 | 8/1969 | Brabham | 343/861 |
| 3,818,480 | 6/1974 | West | 343/749 |
| 4,080,603 | 3/1978 | Moody | 343/752 |
| 4,343,001 | 8/1982 | Anderson et al. | 343/745 |
| 4,611,214 | 9/1986 | Campbell et al. | 343/790 |

*Primary Examiner*—Rolf Hille
*Assistant Examiner*—Michael C. Wimer
*Attorney, Agent, or Firm*—William J. Ruano

[57] ABSTRACT

A transmitting and receiving radio frequency antenna of arcuate shape, serving as a radio frequency radiator of wave lengths between about 2 meters to about 160 meters. A tuning and loading coil is connected to one end of said antenna for tuning and matching said arcuate radiator. A capacitance is connected at the other, coupling to ground. Advantage of vertical and horizontal polarization is obtained.

2 Claims, 4 Drawing Sheets

MOBILE OR GROUND MOUNTED ARCUATE ANTENNA

BACKGROUND OF THE INVENTION

An outstanding disadvantage of antenna constructions, both stationary and mobile, is that the antenna is cumbersome and extends too far in height for many applications. Also they do not have both horizontal and vertical polarization as provided in the present invention.

SUMMARY OF THE INVENTION

The arcuate or "Rainbow" antenna is a new and different type of antenna design wherein the end of the antenna is brought back down to ground in the form of a "rainbow" or arc being capacitance coupled to ground. Another new feature of this antenna is that it has the qualities of both horizontal and vertical polarization as a distinct advantage.

DESCRIPTION OF THE PREFERRED EMBODIMENTS

Figure 1:
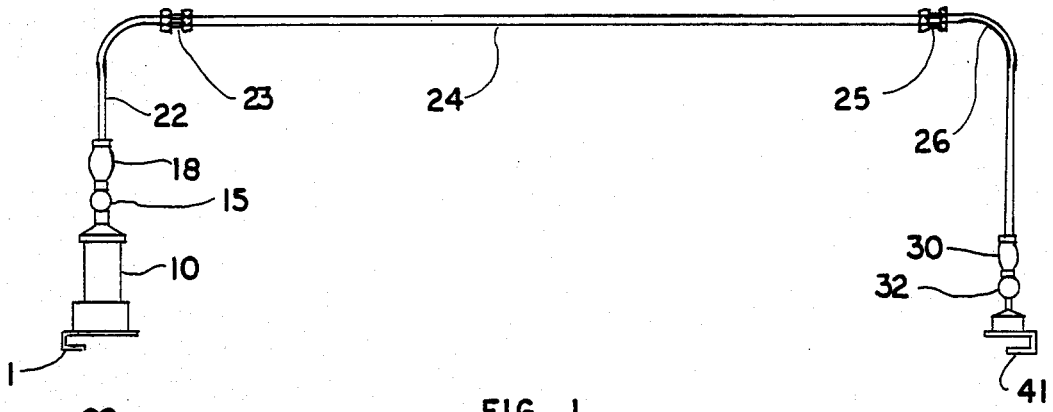
FIG. 1 is an elevational view of the entire antenna construction.
Figure 2:
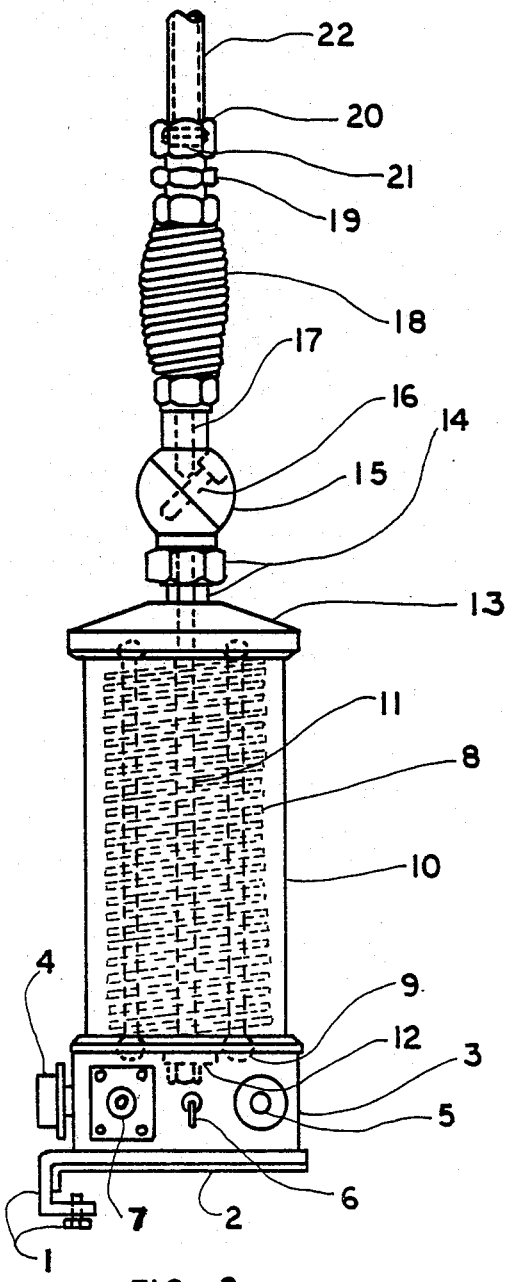
FIG. 2 is an enlarged, fragmentary view of the left portion of the construction shown in FIG. 1.
Figure 3:
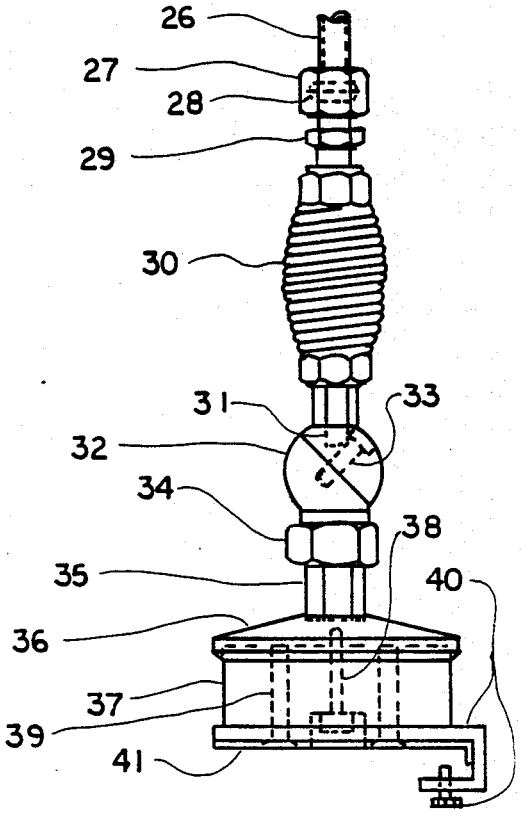
FIG. 3 is an enlarged, fragmentary view of the right portion of the construction shown in FIG. 1.
Figure 4:
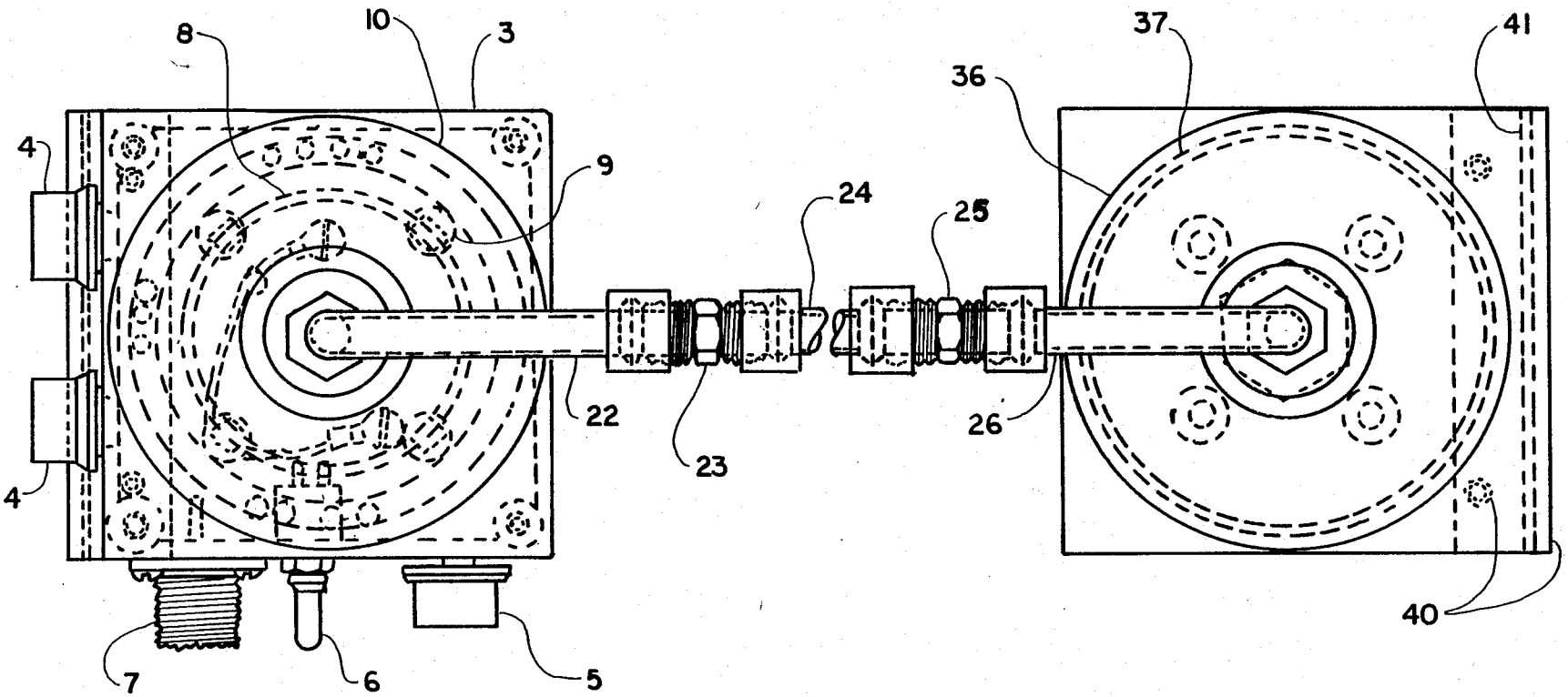
FIG. 4 is a top view of the construction shown in FIGS. 1–3.

There are different models of the "Rainbow" antenna. They are ground mounted, mobile mounted, and marine mounted. These models also have the advantage of being used as a single band or multi-band antenna. Each of these models of the "Rainbow" antenna have much versatility.

In regard to the mobile mounted "Rainbow" antenna, there is the feature and advantage of it being clamp mounted on the trunk of an automobile. This is a distinct advantage in that the antenna has approximately the same height as the automobile roof, thereby making it possible to be permanently mounted on the automobile trunk. Thus, people can drive into parking garages that have low ceilings and low lighting fixtures without having to go outside of the vehicle to remove the antenna. This would also be a safety feature for both people and their vehicles. This is especially true because much longer antennas are required for the lower frequencies and these are being used now so these do not have the safety feature and convenience that the "Rainbow" antenna offers. The mobile mounted antenna has another new feature in that it has the qualities of both horizontal and vertical polarization as a distinct advantage. The mobile mounted "Rainbow" antenna is resonated by a tapped tuning and loading coil with a band switch, a variable capacitor, and a high/low frequency switch. It also uses a fifty ohm impedance coaxial connector input. As a result, all frequencies between 80 meters and 2 meters may be resonated. The center section of the radiator is cut to length when installing, thereby fitting a variety of trunk widths. The mobile mounted "Rainbow" antenna also has breakover springs and split ball adjustment for different angle mounting and safety. This is also a distinct advantage. The mobile mounted "Rainbow" antenna can also be mounted on trailer truck cab tops with appropriate mounting brackets.

The ground mounted "Rainbow" antenna model is also a new and different design in that the end of the antenna is brought back down to ground in the form of a "rainbow" or arc while being capacitance coupled to ground. No other antenna has this feature. Another new feature of the ground mounted "Rainbow" antenna is that it has the quality of both horizontal and vertical polarization as a distinct advantage. The ground mounted "Rainbow" antenna is designed using one quarter electrical wavelength at 7.200 megahertz (32 feet/6 inches) for the bow or arc and one quarter electrical wavelength across at the base for 14.250 megahertz (16 feet/5 inches) which are resonant frequencies. This distance of 16 feet, 5 inches is from the center of the input end to the center of the capacitance coupled end of the antenna. All frequencies between 160 meters and 2 meters may be resonated by the tapped tuning and loading coil with a band switch, a variable capacitor, a high/low frequency switch, and the use of a 50 ohm impedance coaxial connector input.

This ground mounted "Rainbow" antenna may also be resonated at these frequencies by using inductance and capacitive traps in the radiator instead of the tapped tuning and loading coil assembly.

For the marine mounted "Rainbow" antenna you would use either the mobile mounted antenna, or, for larger ships, use the ground mounted "Rainbow" antenna.

It must be remembered that the "Rainbow" antenna is new and unique in that it is capacitance coupled to ground at the end of the antenna and the antenna is brought back to ground in the form of a "rainbow" or arc.

Another advantage of all of the models of the "Rainbow" antenna is that they can be used on a single band or on multi-bands and frequencies. These would include amateur radio bands, citizen band, commercial bands, and government frequencies. The frequencies that are covered by the mobile mounted "Rainbow" antenna would be 80 meters through 2 meters. The frequencies covered by the ground mounted "Rainbow" antenna would be 160 meters through 2 meters. As a result, all of these "Rainbow" antenna models can be used for single band or multi-band purposes.

Referring to FIGS. 1, 2, 3 and 4, mounting bracket clamp and two set screws 1 with neoprene pad 2 attached, to protect automobile body from scratches is clamped to left side of automobile trunk lid surface. The aluminum band switching box 3 is mounted on mounting bracket 1 with four #10–24 machine screws. Band-switching box 3 contains band switch 4, variable capacitor 5, high/low frequency switch 6 (meaning the best position for a higher or lower frequency matching condition) is used to put the variable capacitor 5 either in series or parallel with the coaxial input 7 for the purpose of properly creating a 50 ohm impedance condition. The tapped tuning and loading coil 8 with eight neoprene bumpers 9 attached is mounted inside insulated case 10. Stainless steel machine screw 11 with #10–24 thread is inserted through insulator 12 in band switching box 3 up through the inside of tapped tuning and loading coil 8 through cap piece 13 and threaded into one half of union 14. This stainless steel machine screw 11 is then tightened into one half of the brass union 14 thereby fastening the tapped tuning and loading coil assembly 8 to bandswitching box assembly 3. This stainless steel machine screw 11 also forms the antenna center conductor into the bandswitching box 3.

The other half of brass union 14 is threaded onto split ball angle adjustment 15 with ½"-14 thread. Machine screw 16 tightens the angle setting. The ¼"-20 thread stud 17 fastens stainless steel safety spring 18 to angle adjusted split ball 15. Brass fitting 19 with ⅛"-27 thread is tightened into stainless steel safety spring 18. Brass nut 20 and sleeve 21 are inserted on 5/16" outside diameter aluminum tubing section of "Rainbow" antenna radiator 22 then tightened by compression into brass fitting 19 by compression of sleeve 21. The 5/16" outside diameter aluminum tubing "Rainbow" antenna radiator 22 is then tightened into one end of brass compression fitting union 23. The 5/16" outside diameter aluminum tubing "Rainbow" antenna radiator 24 which is cut to length at installation is tightened into the other end of brass compression fitting union 23. The 5/16" outside diameter aluminum tubing "Rainbow" antenna radiator 24 is now tightened into brass compression fitting union 25 and tightened. The 5/16" outside diameter aluminum tubing "Rainbow" antenna radiator 26 is now tightened into the other end of brass union 25. The other end of the 5/16" outside diameter aluminum tubing "Rainbow" antenna radiator 26 is tightened by brass nut 27 and sleeve 28 into ⅛"-27 threaded brass fitting 29. Stainless steel safety spring 30 is tightened to brass fitting 29. Stainless steel safety spring 30 is tightened by ¼"-20 thread stud 31 into split ball 32. The split ball 32 angle is adjusted and tightened by the ¼"-20 thread machine screw 33 with its ½"-14 thread is tightened to one half of union 35.

The other half of union 35 is tightened into aluminum cap piece 36 and insulated capacitor spacer 37 by #10–24 stainless steel machine screw 38. The four flat head #10–24 machine screws 39 are fastened up through mounting bracket clamp and two set screws 40 into insulated capacitor spacer 37. The neoprene pad 41 attached to protect automobile body from scratches is clamped to right side of automobile trunk lid surface. This aluminum cap piece 36 along with the insulated spacer 39 and grounded to automobile body mounting bracket clamp forms the capacitance to ground mobile mount "Rainbow" antenna.

Figures 5, 5A:
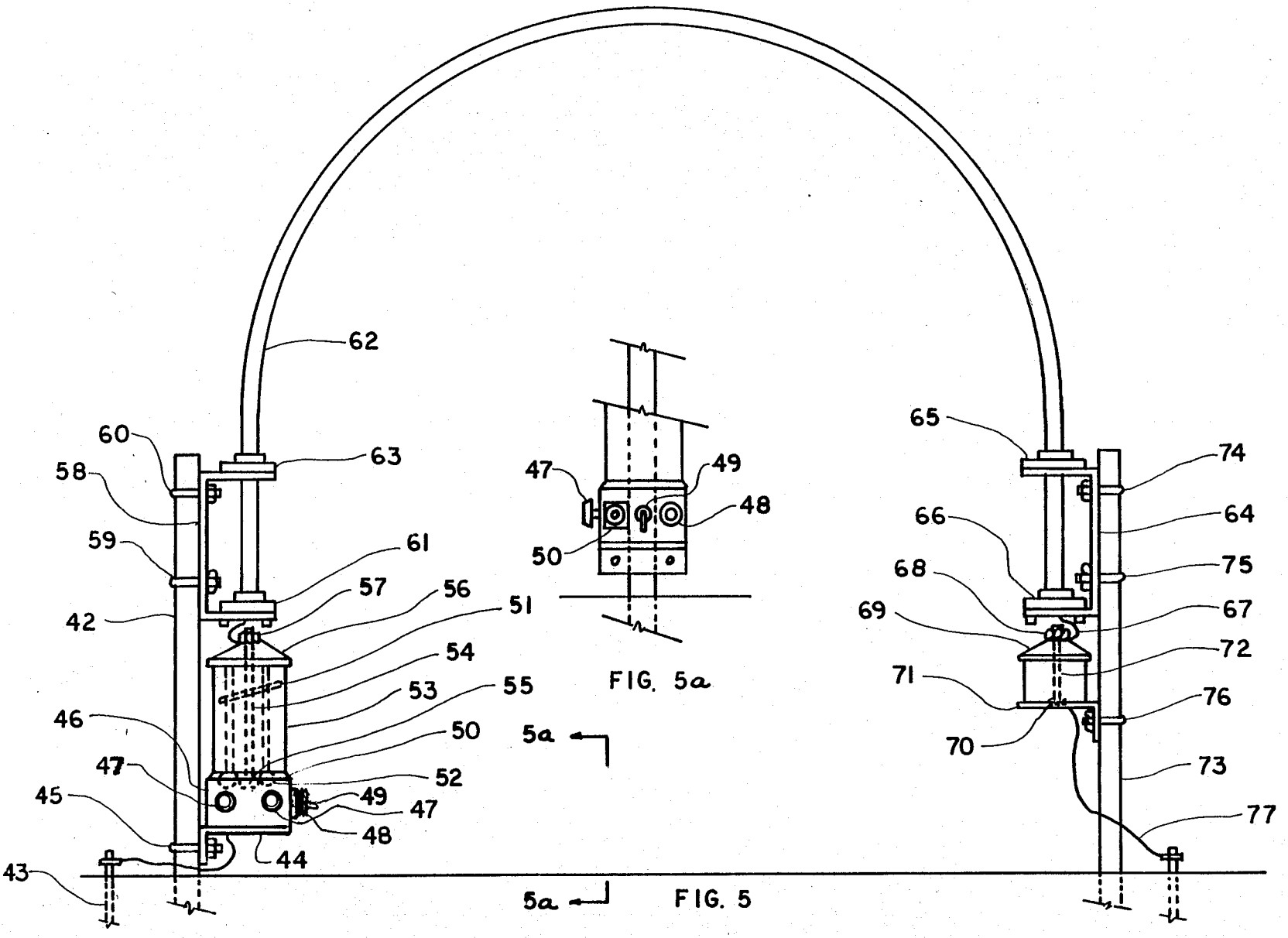
FIG. 5 is an elevational view of a modification.
FIG. 5*a* is a side view taken along line 5*a*–5*a*.
Figure 6:
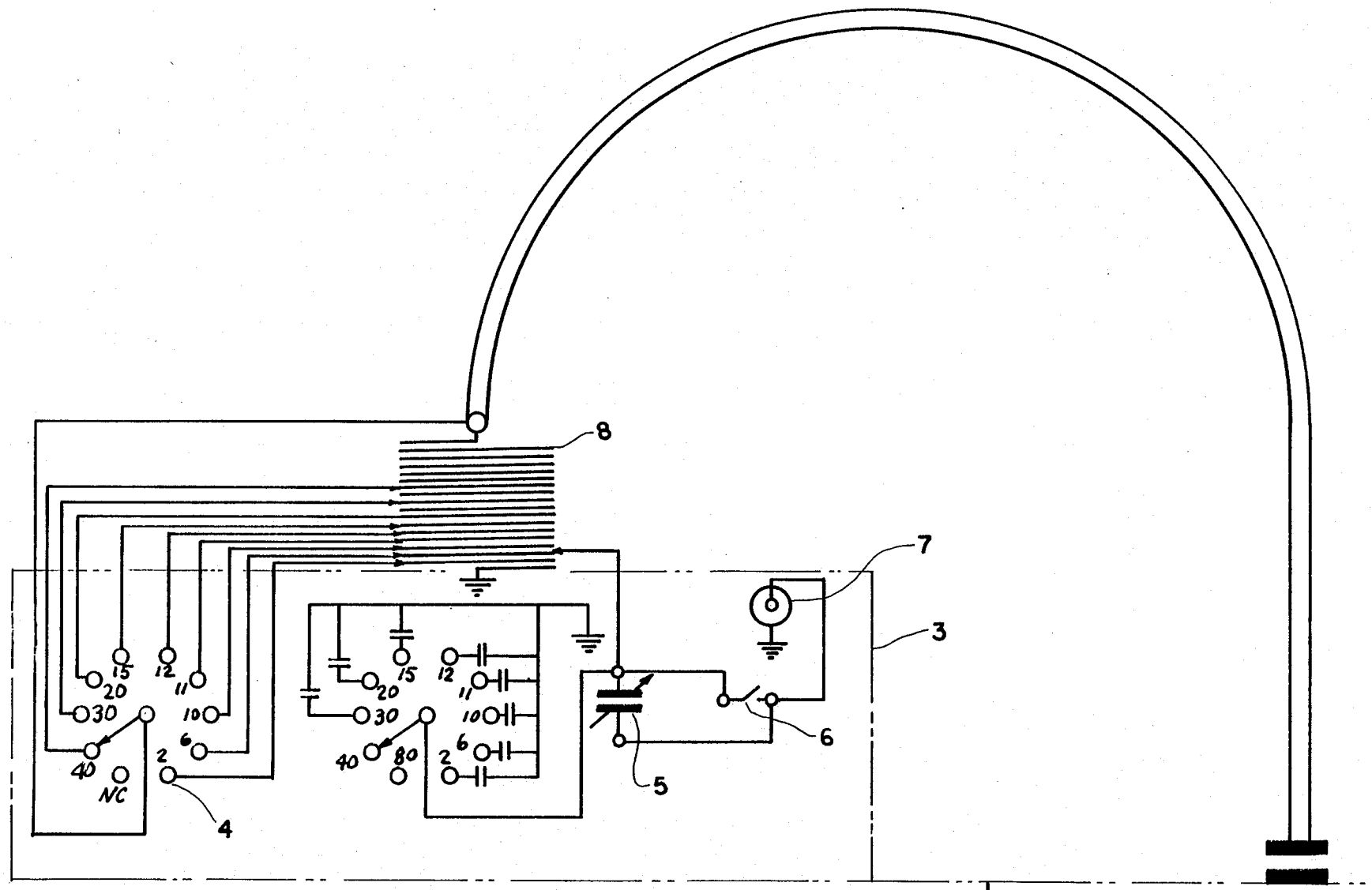
FIG. 6 is a schematic diagram of the construction shown in FIGS. 1–5.

Referring to FIG. 5, aluminum pipe support 42 for mounting ground mounted "Rainbow" or arcuate antenna assembly is installed in the ground to a depth that will be substantial to hold the antenna assembly firm and with a height above ground of 2 feet-4 inches to accept antenna at the input end of antenna assembly. The driven 8 ft. copper ground rod 43 should be connected to mounting bracket clamp 44 with 5/16" threaded "U" bolt 45 to pipe support 42 with #10 copper wire. The aluminum band switching box 46 is mounted on mounting bracket clamp 44 with four #10–24 machine screws. Bandswitching box 46 contains bandswitch 47, variable capacitor 48, high/low frequency switch 49, and coaxial cable input connector 50 along with the necessary wiring as shown on the wiring diagram. The tapped tuning and loading coil 51 with eight neoprene bumpers 52 attached is mounted inside insulated case 53. Stainless steel machine screw 54 with #10–24 thread is inserted through insulator 55 in band switching box 46 up through the inside of tapped tuning and loading coil 51 through cap piece 56 and threaded into #10–24 threaded nut 57.

This stainless steel machine screw 54 also forms the antenna center conductor into the band switching box 46. Tightening this screw 54 holds the loading and tuning coil, insulated case, and band switching box 46 together. Mounting bracket clamp 44 is mounted at six inches above ground. Mounting bracket 58 is held to aluminum pipe support 42 by 5/16 inch "U" bolt 59 and 5/16 inch "U" bolt 60 and tightened to a height of two inches above top of cap piece 56. Mounted in the bottom of mounting bracket 58 is bottom insulator 61 held on mounting bracket 58 with three #10–24 thread machine screws. The "Rainbow" antenna radiator rests in a socket in this insulator 61. At this end of the antenna radiator 62 which is 1 and ¼" outside diameter aluminum tubing, is connected a #10 A.W.G. piece of copper wire to under nut 57 completing the electrical circuit between the antenna radiator and the top of loading and tuning coil assembly and also being insulated from mounting bracket 58. The antenna radiator 62 goes up through the top insulator 63 which is held in place by three #10–24 thread machine screws on the top of mounting bracket 58.

The "Rainbow" antenna radiator 62 then proceeds in a rainbow or arc over to the mounting bracket 64 at the capacitance end of the antenna. This 1 and 1¼ inch outside diameter aluminum tubing is made up of six sections telescoped inside each section five inches for support. The "Rainbow" antenna radiator continues through top insulator 65 which is also mounted with three #10–24 thread machine screws to the top of mounting bracket 64. The antenna radiator continues down into the resting socket in bottom insulator 66 which is attached to mounting bracket 64 by three #10–24 machine screws. At the end of antenna radiator 62 is connected a piece of #10 A.W.G. copper wire 67. The other end of the wire 67 is connected under the nut 68 at the top of cap piece 69. The distance between mounting bracket 64 and the top of cap piece 69 is two inches. The capacitance to ground spacer and insulator 70 is mounted on mounting bracket 71 which is held in place by four #10–24 flat head screws. Stainless steel machine screw 72 goes from the bottom of insulator 70 up through cap piece 69, insulator and spacer 70, and grounded mounting bracket 71 forming a capacitance to ground of this "Rainbow" antenna.

Mounting bracket 64 and mounting bracket 71 are fastened to aluminum pipe support 73 by 5/16" threaded top "U" bolt 74, bottom "U" bolt 75, and grounded mounting bracket Ubolt 76. This aluminum pipe support 73 for the antenna assembly is installed in the ground to a depth that will be substantial to hold the antenna firm and with a height above ground of 1 foot-11 inches. Mounting bracket 71 is fastened to aluminum pipe support 73 six inches above ground. A #10 copper wire 77 is connected from grounded mounting bracket 76 to top of 8 foot driven copper ground rod. The distance from grounded mounting bracket 44 to grounded mounting bracket 71 along the arc is ¼ electrical wavelength at 7.200 megahertz or 32 feet/6 inches. The linear distance between the center of bandswitching box 46 across to center of capacitance insulator 70 is ¼ electrical wavelength at 14.250 megahertz to 16 feet/5 inches.

The ground mounted "Rainbow" antenna can also be used to work in the 160 meter band of frequencies by the addition of another position on the band switch and the matching switch.

In regard to marine use, in a large ship installation the aluminum pipe supports would be clamped to the steel main body of the ship. The 8 ft. driven copper ground rods naturally would not be necessary.

Thus it will be seen that we have provided an efficient and compact arcuate antenna having a capacitance coupling to ground on one end and which is ground mounted or mobile mounted.

While we have illustrated and described several embodiments of our invention, it will be understood that these are by way of illustration only and that various changes and modifications are contemplated in our invention within the scope of the following claims:

We claim:

1. A transmitting and receiving radio frequency antenna having two spaced, parallel, vertical end portions of equal height and an integral intermediate portion bowed upwardly and being of semicircular shape, serving as a radio frequency radiator of wavelengths between about two meters to one hundred-sixty meters comprising a coaxial cable input connector having a grounded outer conductor and an inner conductor connected to a terminal of a high/low frequency switch and a first end of a variable capacitor, said switch arranged to selectively connect said variable capacitor in series with said inner conductor or to short out said variable capacitor so as to connect said first end of said variable capacitor and said inner conductor to a second end of said variable capacitor, said second end of said variable capacitor connected to a first terminal of a variable, tapped tuning and loading inductor and to a variable bandswitch, a second terminal of said inductor connected to one end of one of said vertical end portions at one end of said antenna, and a capacitance coupling connected to an end of a second one of said vertical end portions at the other end of said antenna and coupled to ground, whereby vertical and horizontal polarization is obtained from the shape of said antenna.

2. An antenna as recited in claim 1 which is mobile mounted by having a ground clamp at each end for clamping onto the trunk of an automobile.

* * * * *